US009416607B2

(12) United States Patent
Hallundbæk et al.

(10) Patent No.: US 9,416,607 B2
(45) Date of Patent: Aug. 16, 2016

(54) DOWNHOLE GUIDING TOOL

(75) Inventors: Jørgen Hallundbæk, Græsted (DK); Thomas Sune Andersen, Helsinger (DK)

(73) Assignee: WELLTEC A/S, Allerød (DK)

( * ) Notice: Subject to any disclaimer, the term of this patent is extended or adjusted under 35 U.S.C. 154(b) by 940 days.

(21) Appl. No.: 13/519,405

(22) PCT Filed: Dec. 29, 2010

(86) PCT No.: PCT/EP2010/070835

§ 371 (c)(1),
(2), (4) Date: Oct. 3, 2012

(87) PCT Pub. No.: WO2011/080292

PCT Pub. Date: Jul. 7, 2011

(65) Prior Publication Data

US 2013/0014957 A1 Jan. 17, 2013

(30) Foreign Application Priority Data

Dec. 30, 2009 (EP) ..... 09180926

(51) Int. Cl.

| | |
|---|---|
| ***E21B 31/14*** | (2006.01) |
| ***E21B 17/05*** | (2006.01) |
| ***E21B 23/12*** | (2006.01) |
| ***E21B 4/18*** | (2006.01) |
| ***E21B 7/06*** | (2006.01) |
| ***E21B 41/00*** | (2006.01) |
| ***E21B 23/14*** | (2006.01) |

(52) U.S. Cl.

CPC ..... *E21B 23/002* (2013.01); *E21B 4/18* (2013.01); *E21B 7/067* (2013.01); *E21B 23/14* (2013.01); *E21B 31/14* (2013.01); *E21B 41/0035* (2013.01)

(58) Field of Classification Search

CPC ..... E21B 31/14; E21B 7/067; E21B 17/025; E21B 17/05; E21B 23/03; F16L 27/02; F16L 27/023

See application file for complete search history.

(56) References Cited

U.S. PATENT DOCUMENTS

| | | | | |
|---|---|---|---|---|
| 2,694,549 | A * | 11/1954 | James | 175/82 |
| 5,316,093 | A | 5/1994 | Morin | |
| 5,415,238 | A | 5/1995 | Nice | |
| 5,467,834 | A | 11/1995 | Hughes | |
| 6,216,802 | B1 * | 4/2001 | Sawyer | 175/73 |
| 2001/0052427 | A1 * | 12/2001 | Eppink et al. | 175/40 |
| 2003/0136357 | A1 * | 7/2003 | Kobayashi et al. | 123/41.08 |

(Continued)

FOREIGN PATENT DOCUMENTS

| | | |
|---|---|---|
| AU | 2005203776 | 9/2005 |
| CN | 1413285 | 4/2003 |

(Continued)

OTHER PUBLICATIONS

Office Action dated Nov. 13, 2014; Russia Application No. 2012127112/03; Filing Date: Dec. 29, 2010 (041972); 5 pages.

(Continued)

*Primary Examiner* — Cathleen Hutchins

(74) *Attorney, Agent, or Firm* — Nixon & Vanderhye P.C.

(57) ABSTRACT

The present invention relates to a downhole tool for guiding a device into a side track of a borehole, the tool having a tool axis and comprising a tool housing connected to an energy source. The invention further relates to a method for moving the downhole tool into a side track.

23 Claims, 9 Drawing Sheets

(56) References Cited

U.S. PATENT DOCUMENTS

| | | | | |
|---|---|---|---|---|
| 2006/0042792 | A1 | 3/2006 | Connell | |
| 2008/0135293 | A1* | 6/2008 | Tashiro et al. | 175/45 |
| 2010/0025115 | A1* | 2/2010 | Kotsonis et al. | 175/61 |

FOREIGN PATENT DOCUMENTS

| | | | | |
|---|---|---|---|---|
| EP | 0394567 | | | 10/1990 |
| GB | 2368361 | A | * | 5/2002 |
| RU | 2318111 | C1 | | 2/2008 |
| RU | 2318112 | C1 | | 2/2008 |
| WO | WO2005/028805 | | | 3/2005 |
| WO | WO2008/068561 | | | 6/2008 |

OTHER PUBLICATIONS

English translation; Russia Application No. RU 2318111 C1; publication date: Feb. 27, 2008; 8 pages.
Chinese Office Action dated: Feb. 8, 2014; Chinese Application No. 2010800596683; Filing Date: Dec. 29, 2010; 6 pages.
Chinese Search Report dated Jan. 23, 2014; Chinese Application No. 2010800596683; 2 pages.
English translation; Chinese Search Report; Chinese Application No. 2010800596683; 1 page.
English abstract; Chinese Application No. CN1413285; 1 page.
International Search Report; International Application No. PCT/EP2010/070835; International Filing Date: Dec. 29, 2010; 4 pages.

* cited by examiner

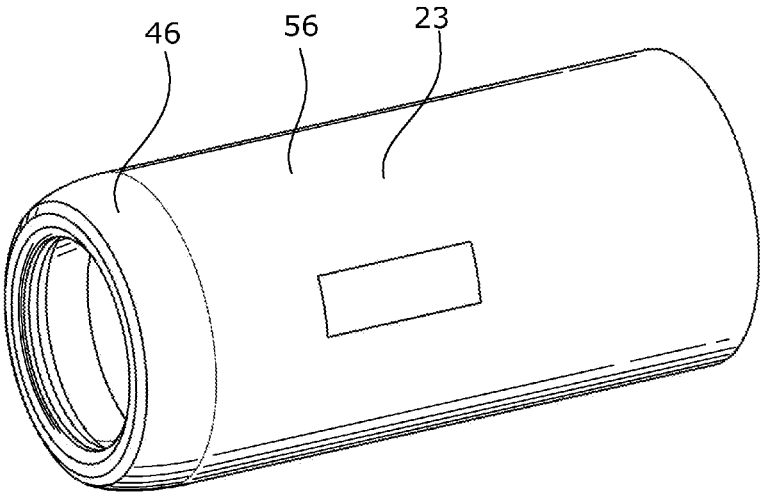
Fig. 7
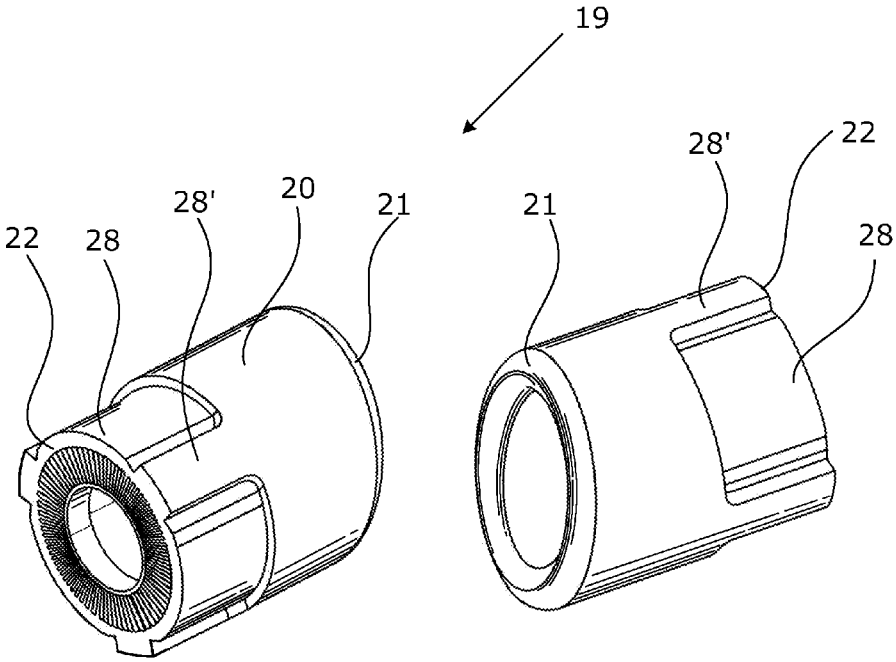
Fig. 8A
Fig. 8B

DOWNHOLE GUIDING TOOL

This application is the U.S. national phase of International Application No. PCT/EP2010/0070835 filed Dec. 29, 2010, which designated the U.S. and claims priority to EP Patent Application No. 09180926.9 filed Dec. 30, 2009, the entire contents of each of which are hereby incorporated by reference.

TECHNICAL FIELD

The present invention relates to a downhole tool for guiding a device into a side track of a borehole, the tool having a tool axis and comprising a tool housing connected to an energy source. The invention further relates to a method for moving the downhole tool into a side track.

BACKGROUND

A device for guiding a borehole servicing tool string into a side track of a borehole is known from U.S. Pat. No. 5,415,238. The device disclosed in this patent is provided with a guiding nose for moving freely past a point of wall separation between the primary borehole and the lateral, and hence, into the lateral. The device is in one embodiment provided with two moving areas/joints; one for providing a rotation of the device around its own centre axis, and another—a hinge—in which the device is displaced out of the axial alignment with the housing.

These two moving joints make the device more complicated, and due to the rotation around the axis, it is not possible to move wires past this joint and on to the next joint—the hinge—as this will cause twisting of the wires. Therefore, the movement of the device can only take place by incorporating several power sources in the device; one for moving the device around its centre axis, and another for moving the device in the lateral direction. Furthermore, it is not possible to have different helping tools arranged in relation to the guiding device as these helping tools also require power and can, as a consequence of that, only be placed before reaching the first joint and not at the tip of the tool after reaching the joint, but with a large distance to the tip of the guiding device.

DESCRIPTION OF THE INVENTION

An aspect of the present invention is, at least partly, to overcome the disadvantages of the device mentioned above, and to provide a tool which is simply constructed and allows for movements in three planes/directions (X, Y and Z planes) in just one part of the construction.

Another aspect is to provide a device which is suitable for guiding tools down into a lateral borehole, which can be placed close to, or even in front of, the tip of the guiding device.

An additional aspect is to provide a guiding device where a logging tool can be arranged in the front of the tool.

The above objects, together with numerous other objects, advantages, and features, which will become evident from the below description, are accomplished by a solution in accordance with the present invention by a downhole tool for guiding a device into a side track of a borehole, the tool having a tool axis and comprising:

a tool housing connected to an energy source, the tool housing comprising:

a guiding nose for guiding the tool into the side track, and a joint for providing a revolving and pivoting motion of the guiding nose, wherein the tool comprises a second means comprising a terminal surface facing the joint and being inclined in relation to a plane perpendicular to the tool axis, and wherein the second means is able to slide along the tool axis to fixate the guiding nose in a position in which the nose inclines in relation to the tool axis.

Furthermore, the invention relates to a downhole tool for guiding a device into a side track of a borehole, the tool having a tool axis and comprising:

a tool housing connected to an energy source, the tool housing comprising:

a guiding nose for guiding the tool into the side track, and a joint for providing a revolving and pivoting motion of the guiding nose, wherein the joint comprises a first and a second part, the first part comprising a recess engaging with a key in the second part.

The downhole tool is placed in a borehole, and a sensor, which is guided into the borehole together with the downhole tool, detects the position of the lateral borehole, also called a side track. Subsequently, the downhole tool is stopped and moved back into a position before reaching the side track, and the joint is activated in a way that allows for movement of the guiding nose in the direction of the side track in that the joint is able to move in two or three directions, or combinations thereof, depending on the position of the side track in relation to the guiding nose. The nose is able to move in a conical section of a ball.

A movement in two directions is to be understood as a movement in an X and Y direction in an X, Y coordinate system in which the longitudinal direction of the tool housing is the Z direction. A movement in three directions is to be understood as a movement in an X, Y and Z direction in an X, Y, Z coordinate system, and even a rotation around its own axis. As the entire movement of the guiding tip takes place in this single joint, the construction is less fragile compared to known devices, and is thus suitable for transporting wires all the way through a downhole tool or at least to the position of the joint.

In one embodiment, the tool may further comprise a driving unit powered by the energy source for providing at least the revolving and pivoting motion.

In another embodiment, one of the first and second parts may be a ball socket and the other may be a ball and socket head.

In yet another embodiment, the joint may comprise a ball and socket joint.

Thus, the joint may comprise a socket.

In addition, the joint may comprise a ball and socket head.

Furthermore, the joint may be a universal joint, a U joint, a Cardan joint, a Hardy-Spicer joint or a Hooke's joint.

Also, the guiding nose may have a first end facing the joint, and the joint may comprise an accessory means for preventing the first end of the guiding means from rotating around the centre axis of the guiding nose.

If logging or measuring equipment is connected in front of the tool, the accessory means ensures that wires connected to this equipment are not twisted and that a slip ring solution is unnecessary.

In one embodiment, the joint may comprise an accessory means ensuring that a movement only takes place in the two directions, the X and Y directions, of the guiding nose.

In another embodiment, the accessory means may comprise at least one groove shaped in the ball and socket head and one key arranged in connection with the ball socket, the key being engaged with the groove.

In this way, the joint can only perform a movement in the X and Y directions which are in a transverse plane perpendicular to the longitudinal axis of the tool housing. However, since the guiding nose is an elongated member connected to the ball and socket head, it is still able to provide a movement in three planes while being prevented from rotating around its own axis.

In yet another embodiment, the tool may comprise a second means comprising a means for fixing or defining the position of the tool.

In addition, the tool may further comprise a driving unit for moving the second means.

Also, the tool may comprise a driving unit, such as a step motor, for rotating the second means.

Furthermore, the second means may comprise an axially slideable bushing arranged in the tool housing concentrically around the axis of the tool housing.

In addition, the axially slideable bushing may comprise the terminal surface facing the joint, the terminal surface of the bushing being declining and forming an angle in relation to a line perpendicular to the centre axis of the tool housing.

The tool housing may also comprise a toothed rim bushing for providing a rotation of the second means by means of an interacting means, the toothed rim bushing being rotatable in relation to the housing and being placed concentrically around the centre axis of the tool housing.

In addition, the position may be a lateral position of the guiding nose, i.e. the centre axis of the guiding nose may form an angle with the centre axis of the tool.

Furthermore, the accessory means may comprise at least one groove shaped in the ball socket and one key arranged in connection with the ball and socket head, the key being engaged with the groove.

In one embodiment, the bushing may be placed inside a socket ball housing, the socket ball housing encircling the bushing and the joint. This solution provides unambiguous relations between the different construction parts.

In another embodiment, the angle may be 10-25°, preferably 15-20°.

In yet another embodiment, the toothed rim bushing may interact with a toothed wheel.

Furthermore, the toothed wheel may be driven by a driving unit which may be a step motor.

Also, the interacting means may be a pater/mater arrangement comprising an elevated area formed in the second means, which is slideably arranged in an abutting cylindrical bushing. This is a simple way of transmitting the rotating force to the axially slideable bushing.

In addition, the axially slideable movement of the second means may be provided by at least one piston rod pushing the second means. This is simple way of transmitting the axial force to the axially slideable bushing.

According to the invention, the number of piston rods may be at least one and preferably three.

In one embodiment, the piston rod(s) may be moved by the driving unit driving a piston and be connected to the piston.

In another embodiment, the driving unit may be a motor or a hydraulic pump.

In yet another embodiment, the energy source may be a wireline.

The invention also relates to a method for moving a downhole tool as mentioned above into a side track, comprising the steps of:

moving the tool into the borehole, detecting a side track, positioning the guiding nose opposite the side track, positioning the second means in a start position, and moving the guiding nose into the position by moving the second means towards the joint in the axial direction of the tool housing by means of the bushing means, whereby the guiding nose is moved by the movement of the second means.

The method may further comprise the step of moving the tool forward, whereby the guiding nose hits against a wall of the side track, thereby guiding the tool into the side track.

The invention relates also to a downhole system comprising the downhole tool described above, the system further comprises a downhole tractor.

Finally, the invention relates to the use of the downhole tool described above in combination with a tractor.

BRIEF DESCRIPTION OF THE DRAWINGS

The invention and its many advantages will be described in more detail below with reference to the accompanying schematic drawings, which for the purpose of illustration show some non-limiting embodiments and in which FIG. 7 shows a perspective view of the socket ball housing, FIGS. 8A and 8B show a perspective view of the second means, the axially slideable bushing.

All these figures are highly schematic and not necessarily to scale, and they show only those parts which are necessary in order to elucidate the invention, other parts being omitted or merely suggested.

DETAILED DESCRIPTION OF THE INVENTION

Figure 1:
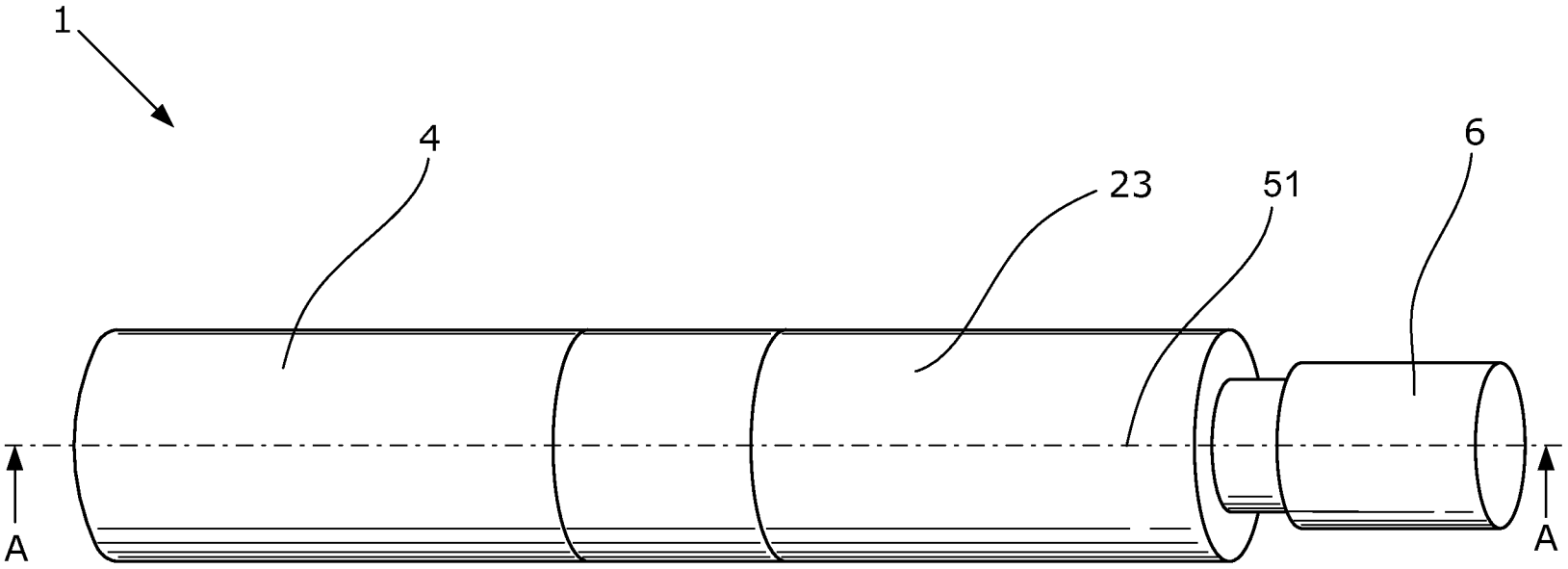
FIG. 1 shows an outside view of a tool according to invention.

FIG. 1 shows a downhole tool 1 according to the invention, comprising an outer tool housing 4. In extension of this housing, a socket ball housing 23 is arranged concentrically around a centre axis 51 of the tool. The socket ball housing 23 surrounds a joint 10, which provides a revolving and pivoting motion. The joint comprises a first 61 and a second 62 part. A revolving and pivoting motion should be understood as a pivoting and spinning movement around a central point, and even a rotating movement around the centre axis 53 of the guiding nose 6. The joint 10 is in this embodiment constructed as a ball and socket joint 12, however it could be any kind of joint, such as a universal joint, a U joint, a Cardan joint, a Hardy-Spicer joint or a Hooke's joint, allowing the guiding nose 6 to move, thereby causing revolving or pivoting motions, at least in the X and Y planes and also occasionally in the Z direction. In continuation of the socket ball housing 23 and in integrated connection with the ball and socket head 14, the guiding nose 6 is formed. This guiding nose 6 is able to make revolving and rotating motions in a conical pattern around the tool axis 51.

Figure 2:
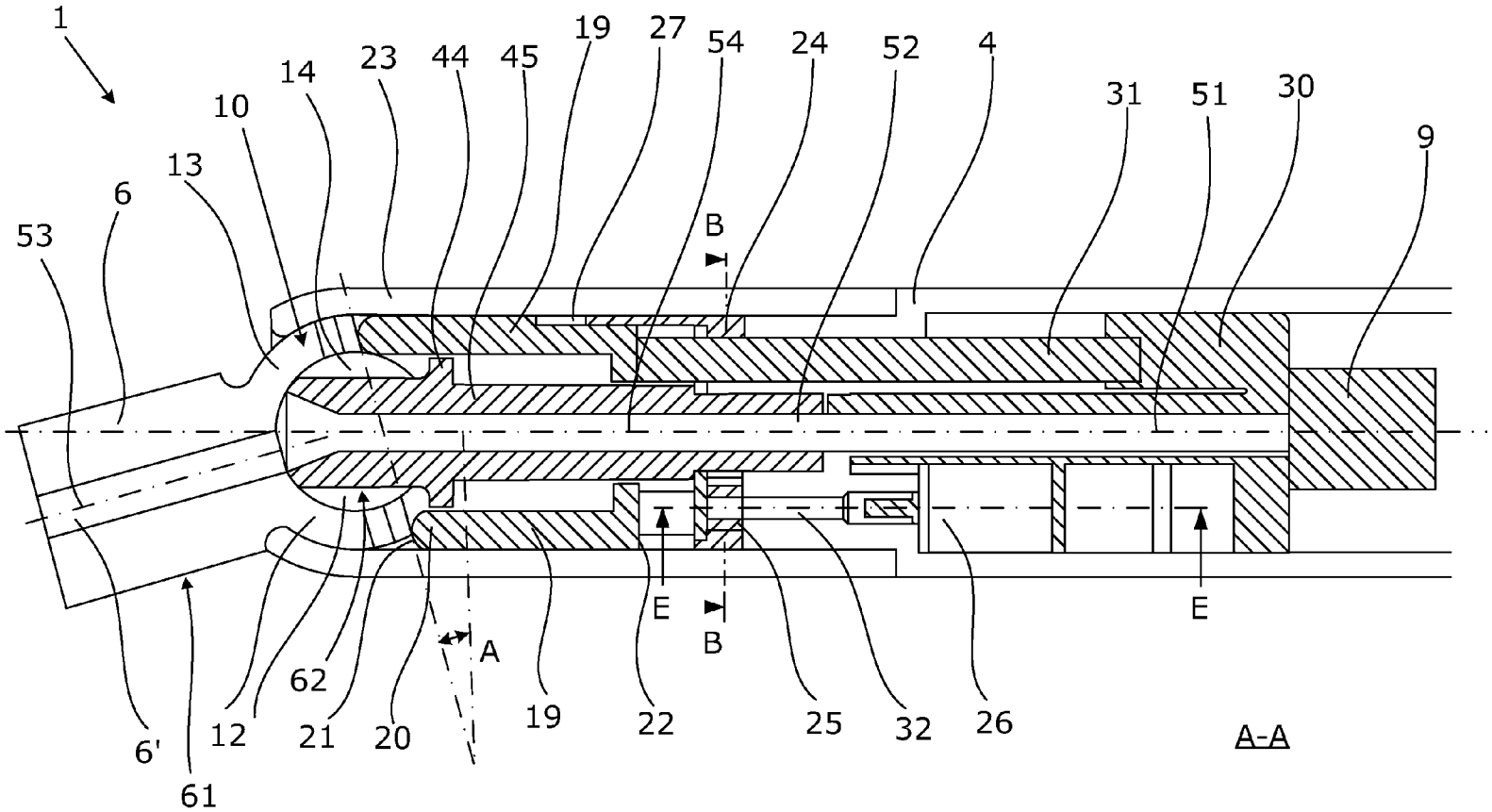
FIG. 2 shows a cross-section through the tool on line AA of FIG. 1.

FIG. 2 shows a cross-section of the downhole tool 1 shown in FIG. 1 along the section line A-A. The downhole tool 1 comprises an outer cylindrical part being a tool housing 4 arranged concentrically around the centre axis 51 of the downhole tool 1. In continuation of the tool housing 4, a socket ball housing 23 is arranged which also comprises a part of the tool housing 4, the socket ball housing 23 also being a cylindrical device or a socket bushing 56 arranged concentrically around the centre axis 51 of the tool 1. Inside the socket ball housing 23, a cylindrical toothed rim bushing 24 is arranged concentrically around the centre axis 51 of the downhole tool 1. The rim bushing 24 is able to rotate more than 360° and is rotatably arranged around the centre axis 54, 51.

Figure 3:
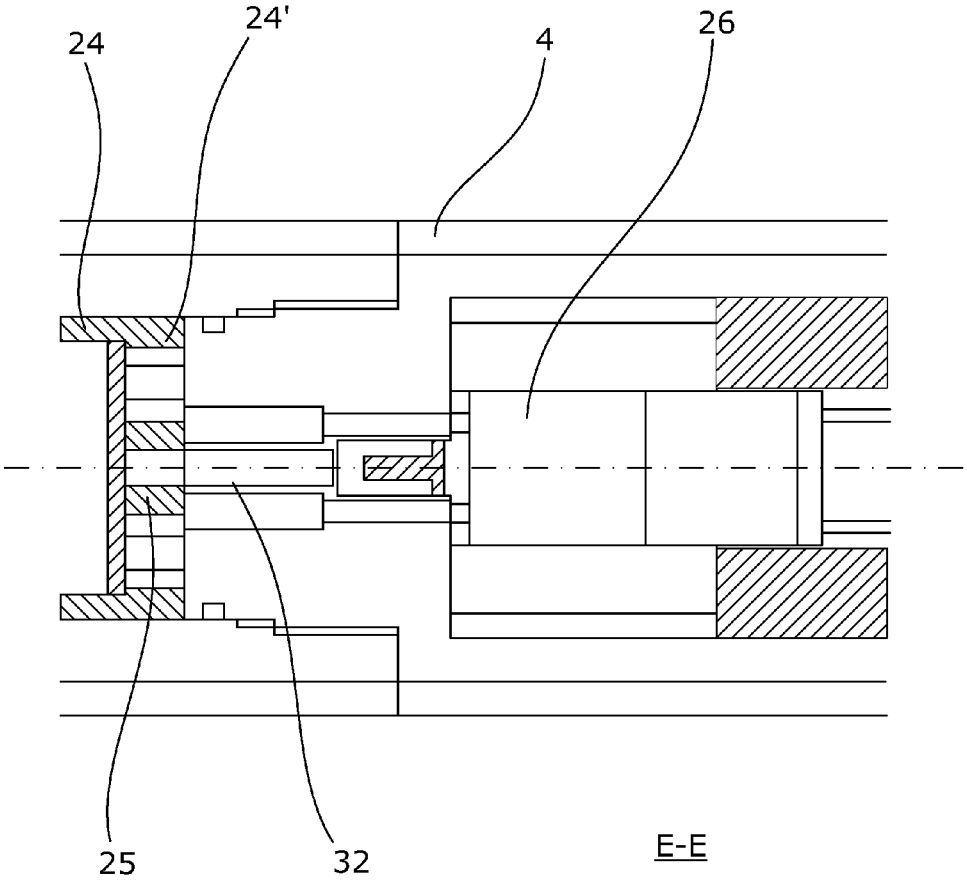
FIG. 3 shows a cross-section through the tool on line EE of FIG. 2.

The rotation happens as a consequence of the toothed rim 24' being arranged on the inside of the bushing 24 and interacting with a toothed wheel 25 which is driven by a step motor 26, as can be seen in FIGS. 2 and 3. The toothed wheel 25 is connected to the step motor 26 by means of a shaft 32. The toothed rim bushing 24 is a pater/mater arrangement 27 intermeshing with another bushing 19, 20 also referred to as the second means 19. The second means 19 is in this embodiment formed as a cylindrical bushing 19, 20 which is axially slideable. This axially slideable bushing 19, 20 is also able to rotate around its own centre axis 53 which coincides with the centre axis 51 of the tool housing 4.

Figure 9:
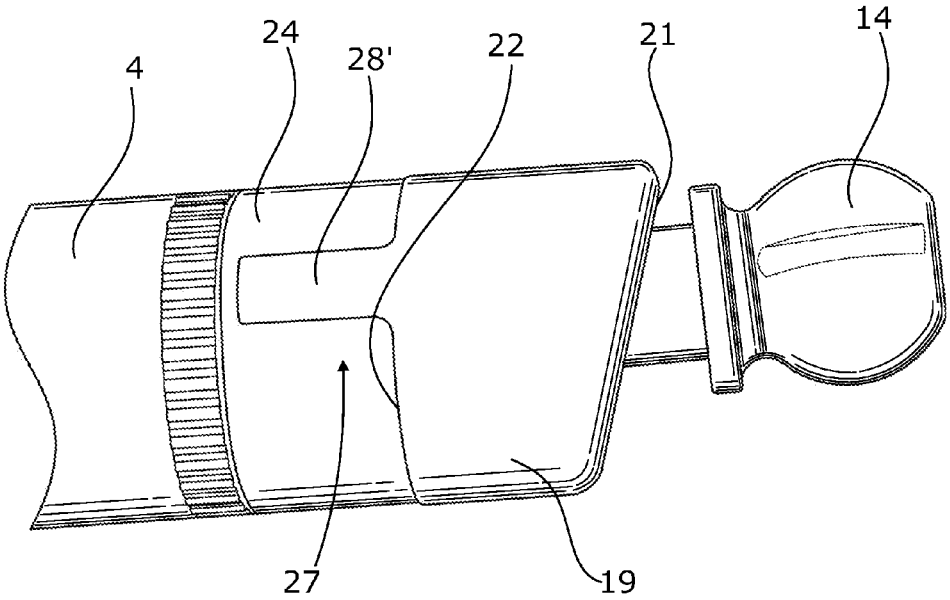
FIG. 9 shows a perspective view of the ball and socket head and the axially slideable bushing.

The rotating motion of the second means 19 happens due to the interaction of the pater/mater arrangement 27 as a consequence of the movement of the rim bushing 24 when the rim bushing 24 turns. The rotating motion caused by the rim bushing 24 is transferred to the second means 19 due to the interaction of the pater/mater arrangement 27. The pater/mater arrangement 27 may typically be formed by providing a toothed rim bushing 24 with recesses at its end pointing towards the axially slideable bushing 19, 20. The axially slideable bushing 19, 20 is formed with rectangular tongues which interact with corresponding recesses formed in the toothed rim bushing 24. This is also shown in FIGS. 8A, 8B and 9 and is further explained below in connection with the description of FIGS. 8A and 8B.

The terminal surface 22 of the axially slideable bushing 19, 20 pointing towards the toothed rim bushing 24 is cut off in a plane cut, and the other terminal surface 21 pointing towards the guiding nose 6 is formed with a declining terminal surface 21 forming an angle A between the plane of the terminal surface 21 and a line perpendicular to the centre axis 51 of the tool. This angle A is typically between 10-25°, preferably between 15-20°.

The declined terminal surface 21 of the bushing 19, 20 is directed towards the joint 10 which is a ball and socket joint 12. Thus, the joint 10 comprises a first part 61 which is a ball socket 13 which is arranged rotatably around the second part 62 which is a ball and socket head 14. The ball and socket head 14 is arranged in the tool housing in such a way that the centre axis 54 of the ball and socket head 14 coincides with the centre axis of the tool housing. The ball and socket head 14 is arranged immovably on a shaft 45 having a circumferential projecting area 44 providing the correct position of the ball and socket head 14 in relation to the axially slideable bushing 19, 20. The ball and socket head 14, the shaft 45 and the projecting area 44 may be moulded as one part. The shaft 45 has a through-going bore 52 through which wires can be arranged.

The circumferential projecting area 44 abuts the inside surface of the axially slideable bushing 19, 20. The ball socket 13 partly surrounds the ball and socket head 14 and is connected with, or completely integrated with, the guiding nose 6 at the end of the ball socket opposite the surface abutting the inclined terminal surface of the axially slideable bushing 19, 20. As the ball socket 13 moves, which movement may be a hinged or rotating movement or both, or combinations thereof, the guiding nose 6 will move with or follow the movement of the ball socket 13. This is due to the movement of the axially slideable bushing 19, 20 and the interface between the declined surface 21 of the axially slideable bushing 19, 20 and a plane terminal surface 55 of the ball socket 13.

The guiding nose 6 could be elongated with another cylinder encircling the guiding nose 6 which is preferably formed as a cylindrical part. The guiding nose 6 could also preferably be tapered in the front. Furthermore, the guiding nose 6 is provided with a channel 6' through which wires could be placed in order to supply a helping tool 38, such as a logging equipment, in front of the downhole tool 1.

The end surface 55 of the ball socket 13 pointing towards the axially slideable bushing 19, 20 is plane in order to precisely follow the movement of the axially slideable bushing 19, 20. When the axially slideable bushing 19, 20 is axially displaced and the inclined surface points towards the plane surface of the ball socket 13, the ball socket moves into the desired position, and the guiding nose 6 will thereby move into its position.

The movement of the guiding nose 6 is a spacious movement in three directions; X, Y and Z, or combinations thereof, providing a revolving and pivoting motion. However, the ball and socket joint 12 is advantageously provided with a key/pin in the ball socket 13, interacting with a groove 17 arranged in the ball and socket head 14. In this way, the movement of the ball and socket joint 12, and thereby the movement of the guiding nose 6, are reduced to a movement only in the X and Y directions and combinations thereof, and rotation of the guiding nose 6 around its own axis 53 is thereby avoided.

The rotation of the toothed rim bushing 24 is provided by a rotation of the toothed wheel 25 which is placed on a rotating shaft 32 rotated by the step motor 26. This means that when the toothed wheel 25 turns, the toothed rim bushing 24 rotates, and the movement of the toothed rim bushing 24 is transferred to the axially slideable bushing 19, 20 by means of the pater/mater arrangement 27. In this way, the angled surface of the axially slideable bushing 19, 20 takes a position where the inclined surface points towards the side of the casing 57 in which the side track 2 is placed. Subsequently, an axial movement of the axially slideable bushing 19, 20 is performed by a driving unit 9, such as a motor or a hydraulic pump, ensuring that a piston 30 is pushed forward in the direction of the guiding nose 6, the motor and the slideable piston 30 being placed inside the tool housing 4.

The piston 30 transfers the force to the axially slideable bushing 19, 20 by means of at least one piston rod 31, and a terminal surface of the piston rod has a resting surface at a plane surface 22 of the axially slideable bushing 20. The number of piston rods 31 could be one or more, preferably three. Due to the axial movement of the axially slideable bushing 19, 20, the declined terminal surface 21 of the bushing 20 is pushed against the plane end surface 55 of the ball socket 13, ensuring that the ball socket 13 is displaced, and the guiding nose 6 is thus moved in the desired direction.

Due to these mechanical movements of parts of the downhole tool 1, the final positioning of the guiding nose 6 takes place, and the guiding nose 6 is now turning in the direction of the side track 2 and is guiding the downhole tool 1 when moved forward in the casing 57. Typically, a sensor is arranged in the downhole tool 1 in such a way that it is able to detect the position of the side track 2, and the downhole tool 1 is placed in the right position in the main casing, ensuring that the guiding nose 6 is positioned opposite the side track 2. The movement of the guiding nose 6 taking place at the tip of the downhole tool 1 ensures that wires can be provided inside the tool housing 4 without twisting the wires, at least until the point where the joint is placed. Furthermore, the movement of the nose 6 taking place in at least the X or Y direction of a conventional coordinate system where the tool axis 51 is the Z direction also enables wires being provided inside the tool housing 4 without twisting the wires, at least until the point where the joint is placed. If the joint is also provided with means preventing a rotation of the guiding nose 6 of more than 360° around its axis 54, the wires may continue past the moving joint and into a helping tool 38 or logging tool which may be placed in continuation of the guiding nose 6, and the wires will thus not be twisted although the nose is rotated.

FIG. 3 shows a detailed view along the section E-E of FIG. 2 showing the tool housing 4 and a step motor 26 arranged inside the tool housing 4. The step motor 26 drives a shaft 32 which is connected to the toothed wheel 25 driving the toothed rim bushing 24 as the toothed wheel 25 interacts with a rim 24' arranged on the inside surface of the toothed rim bushing 24.

Figure 4:
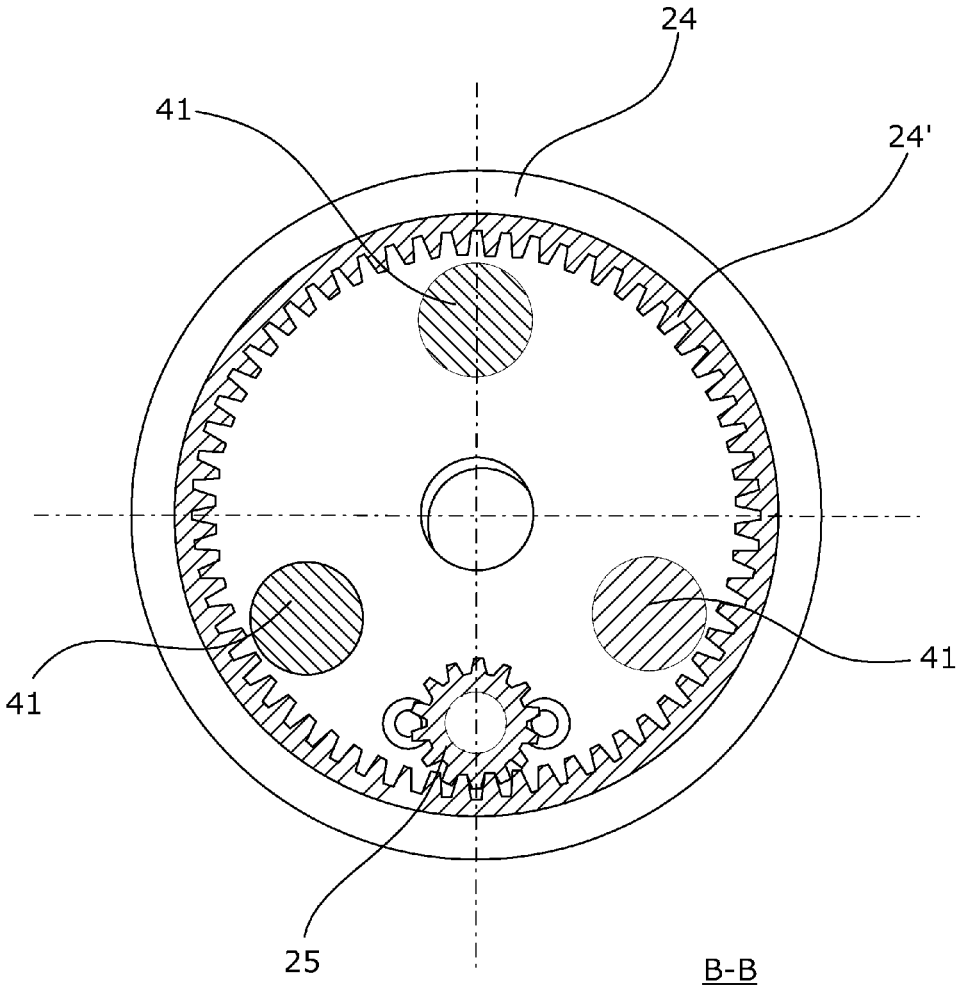
FIG. 4 shows a cross-section through the tool on line BB of FIG. 2, FIGS. 5A and 5B show a perspective view of a part of the joint including a ball socket.

FIG. 4 shows a sectional view along the line B-B of FIG. 2 during an interaction of the toothed wheel 25 and the rim 24' of the toothed rim bushing 24. It also shows the bottom part of the axially slideable bushing 19, 20 which is provided with areas 41 having a higher friction. In this case, three such areas are provided. These areas create a good connection between the axially slideable pistons and the terminal surface 22 of the axially slideable bushing 20.

Figure 5A:
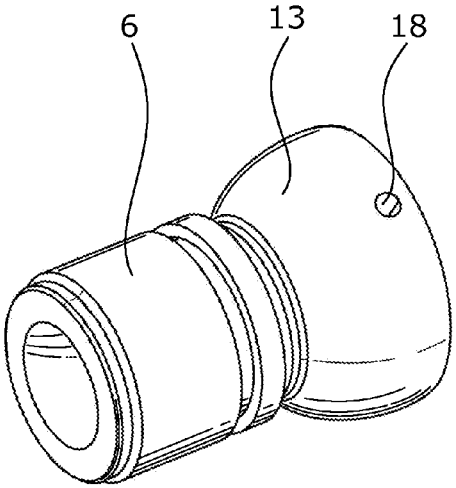
Figure 5B:
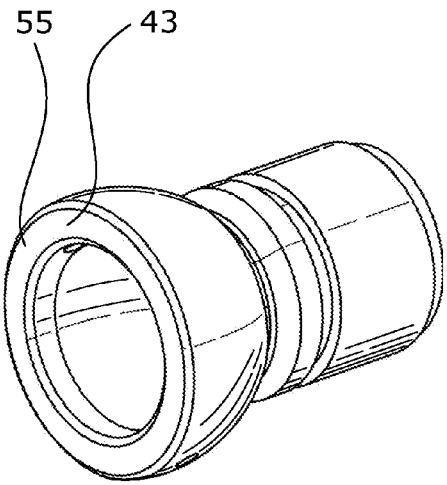
Figure 6:
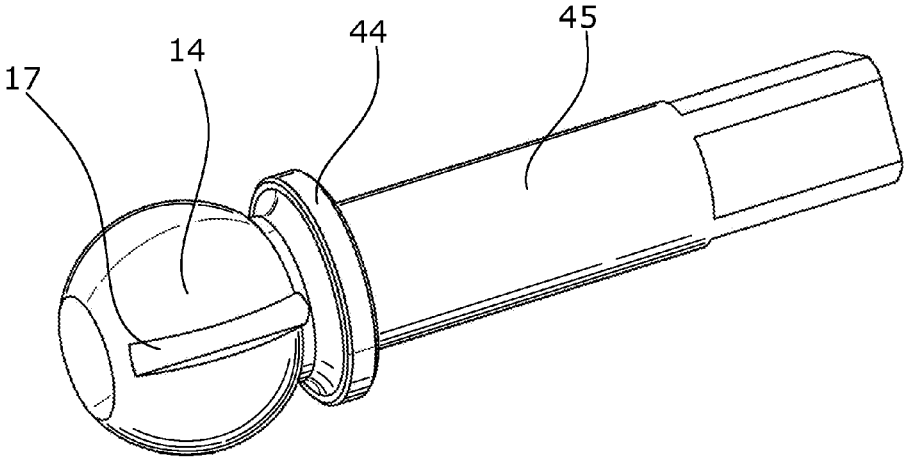
FIG. 6 shows a perspective view of a part of the joint including a ball and socket head.

Referring to FIGS. 5A, 5B and 6, it will now be explained how the movement can be reduced to a movement in the X and Y directions. FIG. 5A shows a part comprising both the ball socket 13 and the guiding nose 6 or a part of the guiding nose 6. This part is placed concentrically around the ball and socket head 14 and moves rotatably around the same. A terminal surface 55 of the ball socket is plane and forms an interfaced surface 43 to the axially slideable bushing 20 as this surface faces the terminal declined surface 21 of the slideable bushing 20. In the ball socket 13, a key/pin is arranged. This could be an integrated part arranged on the inner side of the socket, pointing radially towards the centre of the axis, or it could simply be an exchangeable pin arranged in a hole in the ball socket 13. This key/pin interferes with a recess arranged in the ball and socket joint 12, the recess 17 being shown in FIG. 6. In FIG. 5A, the part comprising both the ball socket 13 and the guiding nose 6 is shown from one end of the part, and in FIG. 5B, the part comprising both the ball socket 13 and the guiding nose 6 is shown from the other end of the part. The embodiment of FIGS. 5A and 5B varies from the embodiment of FIGS. 1 and 2 in that the guiding nose 6 is provided with several recesses in the form of grooves to be able to connect easily with other tools or devices arranged in front of the tool.

In FIG. 6, the recesses 17 are placed or formed parallel with the centre axis of the tool housing 4. There are preferably two recesses 17, one on each side of the ball and socket head 14, ensuring that when the key interferes with the recess, the ball socket 13 can only move in the X and Y directions but is unable to rotate around the Z direction. In this way, it is avoided that wires in the channel 6' and bore 52 passing the joint 10 are twisted, as a rotation of 360°×N (N=1:∞) is avoided. This key and recess arrangement could of course also be opposite in that the key could be placed in the ball and socket head 14, and the recess 17 could be placed on the inside surface of the ball socket 13. There are preferably two keys on either side of the ball and socket head 14.

FIG. 7 is a detailed view of the socket ball housing 23 and shows a tapered end 46 of the socket bushing, this end partly surrounding the ball socket 13 and hindering the part comprising the ball socket 13 and the guiding nose 6 from moving away from the ball and socket head 14.

FIG. 8A shows a perspective view of the second means 19 formed as an axially slideable bushing 19, 20 comprising the cylindrically formed housing which in one terminal end is plane, this end pointing towards the rim bushing 24. The other terminal end 21 is inclined in such a way that the end surface forms an angel A with the line perpendicular to the centre axis of the bushing 19, 20, this centre axis being coincident with the centre axis of the tool housing 4. In FIG. 8A, the second means in the form of the bushing 19, 20 is shown from one end of the bushing, and in FIG. 8B, the bushing is shown from its other end.

At the plane end, the bushing 19, 20 is arranged with areas interacting with the rotating rim bushing 24 comprising rectangular areas being elevated and forming tongues 28', and between these areas, rectangular areas with reduced thickness 28 are formed, which the flange of the rim bushing will slide into and form thereby a pater/mater locking system.

FIG. 9 shows a perspective view of the ball and socket head 14 placed on the shaft 45. This shaft 45 is surrounded by the axially slideable bushing 19, 20, and the angled terminal surface 21 of the axially slideable bushing 19, 20 points towards the head 14.

The other terminal surface 22 points towards the rim bushing 24 and intermeshes with the toothed rim bushing 24 due to the pater/mater arrangement 27 described above. This intermeshing arrangement could be constructed in several other ways, e.g. it could be small pins intermeshing into small cylinders holes. It is important that the interface ensures that the rotation of the rim bushing 24 is transferred to the slideable bushing 19, 20 and that the rim bushing 24 and the slideable bushing 19, 20 are axially displaceable in relation to each other when the declining surface 21 of the slideable bushing 20 has reached its desired position.

Figure 10:
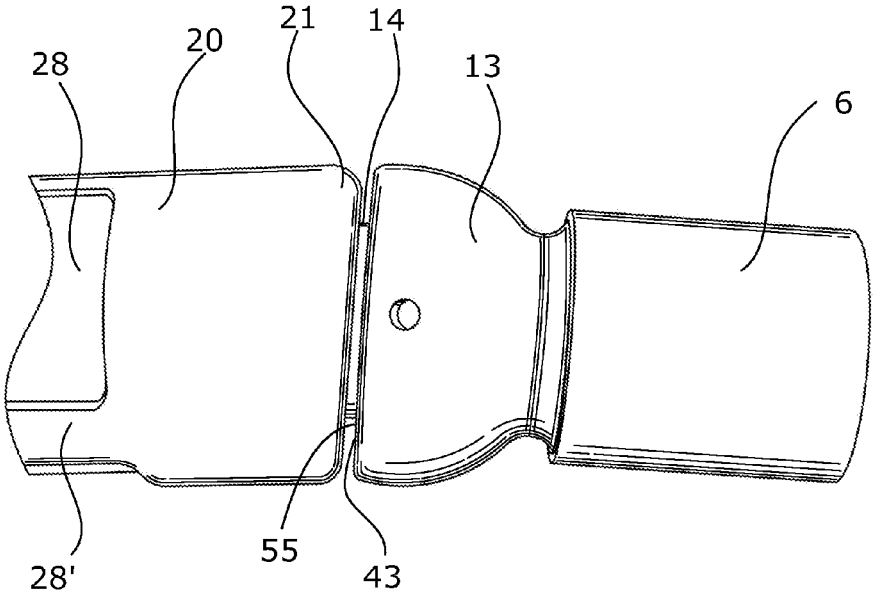
FIG. 10 shows a perspective view of the ball socket integrated with the guiding nose and the axially slideable bushing where the housing is removed.

FIG. 10 shows a perspective view of the ball socket integrated with the guiding nose 6 and the axially slideable bushing 19, 20 where the socket ball housing 23 has been removed.

The guiding nose is 6 connected to the ball socket 13, and they can be integrated parts moulded together, or the nose 6 could be a separate part fastened to the socket 13. The length of the guiding nose 6 can also vary and be telescopically formed. The telescopic function could be activated by means of the same power unit as that driving the means to position the guiding nose 6. The interface formed by the plane terminal surface 55 of the ball socket 13 and the inclined terminal surface 21 of the slideable bushing 20 determines the position of the guiding nose 6.

Figure 11:
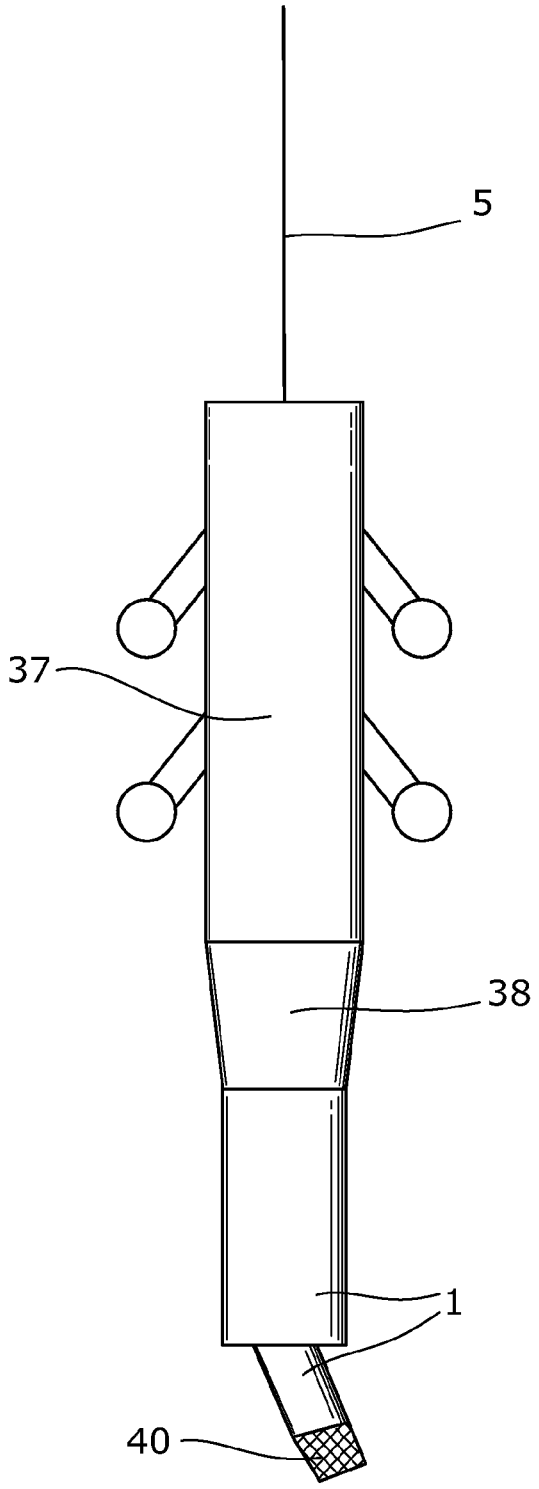
FIG. 11 is a principle figure of the tool according to the invention and its relation to a tractor and helping tools.

FIG. 11 shows a principle figure of the downhole tool 1 according to the invention and its relation to a downhole tractor 37 and helping tools 40. The downhole tool 1 according to the invention is typically operated by a downhole tractor 37. The guiding tool 1 is arranged in front of the downhole tractor 37, and a helping tool 38 is typically arranged between these two or in front of guiding the downhole tool 1. The helping tool 38 could be a pressure sensor which is transported safely down into the side tack 2 due to the guiding tool/downhole tool 1. The downhole tractor 37 is used to draw and/or push the entire construction in the casing and is powered by energy from a wireline 5. A downhole tractor is any kind of driving tool able to push or pull tools in a valve downhole, such as a Well Tractor®.

In front of the guiding tool 1, logging or measuring equipment or another helping tool 38, i.e. a milling tool 40 or a filter, could be placed. In this case, the helping tool 38 is typically supplied with power by wires which are placed in the bore 52 and the central channel 6' in the guiding nose 6 and pass the joint and the guiding nose.

Figure 12:
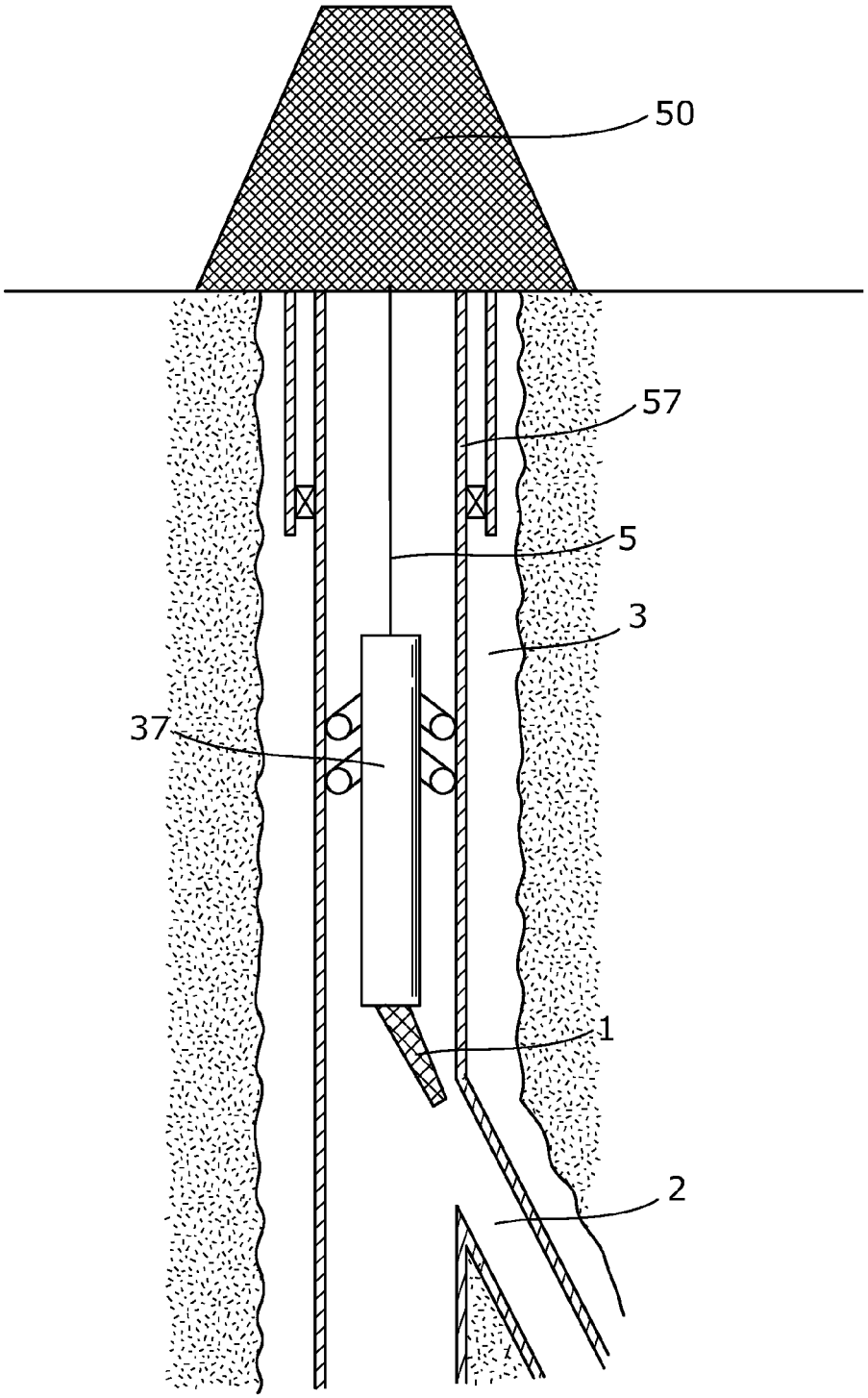
FIG. 12 is a principle figure of the tool according to the invention and its relation to a tractor and helping tools, placed in a borehole provided with a side track.

FIG. 12 shows a principle figure of the downhole system comprising a downhole tool 1, a downhole tractor 37 and helping tools 38. The downhole system is arranged in a casing 57 provided with a side track 2, and the nose 6 is moved into position in order to guide the tool 1 into the side track 2.

A downhole tool 1 according to the invention is placed in a casing 57 in a borehole 3 closed at the top by a well head 50. The movement of the guiding nose 6 is driven by a driving unit 9, such as a motor or a hydraulic pump, and the downhole tool 1 is driven by a downhole tractor 37 which is supplied with energy by a wireline 5. The wireline 5 is connected to a power supply, e.g. an oil rig, situated above surface. This power supply also supplies the tool 1.

When the guiding nose 6 is opposite the side track 2, the nose 6 moves into the right position and is caught by the walls of the side track 2 when the tool 1 moves forward in the casing 57. As the entire tool 1 is pushed further downwards, the nose 6 ensures that the tool is guided into the side track 2 and further down in it.

A wire made of fibreglass may be arranged in the channel 6' and bore 52 and be fixated in the piston 30. When the guiding nose 6 is not fixated in an inclined position by means of the bushing 19, 20, it may hang loose from the rest of the downhole tool 1. By arranging a fibreglass wire in the channel 6' and the bore 52, the wire will lead the guiding nose 6 into a position where it is inclined as little as possible and where a centre axis 53 is more parallel to a centre axis 54 of the shaft. This is due to the fact that the wire is flexible and bendable when the nose 6 is inclined, but the wire is still rigid and will flex back into its relaxed position, thereby forcing the nose 6 to assume en uninclined position.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

| | | | |
|---|---|---|---|
| 1 | Downhole tool | 23 | socket ball housing |
| 2 | side track | 24 | toothed rim bushing |
| 3 | bore hole | 24' | toothed rim |
| 4 | tool housing | 25 | toothed wheel |
| 5 | energy source | 26 | step motor |
| 6 | guiding nose | 27 | pater mater arrangement |
| 6' | channel | 28' | elevated area |
| 7 | Joint | 29 | recess groves |
| 8 | Position | 30 | piston |
| 9 | driving unit | 31 | piston rod |
| 10 | joint | 32 | shaft |
| 11 | second position | 33 | wireline |
| 12 | ball and a socket joint | 37 | tractor |
| 13 | ball socket | 38 | helping tool |
| 14 | ball and socket head | 40 | mill tool |
| 15 | center axis | 41 | Friction area for piston rod |
| 16 | accessory means | 43 | interface surface |

-continued

| | | | |
|---|---|---|---|
| 17 | groove | 44 | circumferential projecting area |
| 18 | key | 45 | shaft ball and socket head shaft |
| 19 | second means | 50 | rig |
| 20 | bushing | 51 | centre axis of tool |
| 21 | terminal surface | 52 | bore |
| 22 | terminal surface | 53 | centre axis of guiding nose |
| 55 | terminal surface of socket | 57 | casing |
| 56 | device/socket housing | 62 | second part |
| 61 | first part | | |

The invention claimed is:

1. A downhole tool for guiding a device into a side track of a borehole, the tool having a tool axis and comprising:

a tool housing connected to an energy source, the tool housing comprising:

a guiding nose for guiding the tool into the side track; and a joint for providing a revolving and pivoting motion of the guiding nose;

wherein: the tool comprises a cylindrical bushing, the cylindrical bushing being axially slidable and arranged in the tool housing concentrically around a stationary longitudinal shaft arranged along the tool axis;

the cylindrical bushing comprises a terminal surface facing the joint, the terminal surface being declining and forming an angle in relation to a line perpendicular to the tool axis; and the cylindrical bushing is able to slide along the tool axis to fixate the guiding nose in a position in which the guiding nose inclines in relation to the tool axis.

2. The downhole tool according claim 1, wherein the joint comprises a first and a second part, the first part comprising a recess engaging with a key in the second part.

3. The downhole tool according to claim 2, wherein the one of the first and the second parts is a ball socket and the other is a ball and socket head.

4. The downhole tool according to claim 1, wherein the joint is selected from the group consisting of a ball and socket joint, a universal joint, a U joint, a Carden joint, a Hardy-Spicer joint and a Hooke's joint.

5. The downhole tool according to claim 1, wherein the guiding nose has a first end facing the joint and the joint comprises an accessory device for preventing the first end from rotating around a centre axis of the guiding nose.

6. The downhole tool according to claim 5, wherein the joint comprises a ball socket and a ball and socket head, and wherein the accessory device comprises at least one groove shaped in the ball and socket head and one key arranged in connection with the ball socket, the key being engaged with the groove.

7. The downhole tool according to claim 1, further comprising a driving unit for moving the bushing.

8. The downhole tool according to claim 1, further comprising a driving unit for rotating the bushing.

9. The downhole tool according to claim 8, wherein the tool housing further comprises a toothed rim bushing for providing a rotation of the bushing by an interacting device, the toothed rim bushing being rotatable in relation to the tool housing and being placed concentrically around a centre axis of the tool housing.

10. The downhole tool according to claim 8, wherein the driving unit for rotating the bushing is a step motor.

11. A downhole system comprising the downhole tool according to claim 1, the system further comprising a downhole tractor.

12. A method for moving the downhole tool according to claim 1 into the side track, the method comprising the steps of:

moving the downhole tool into the borehole, detecting a side track, positioning the guiding nose opposite the side track, positioning the bushing in a start position, and moving the guiding nose into a second position by moving the bushing second means towards the joint in an axial direction of the tool housing, whereby the guiding nose is moved by the movement of the bushing.

13. The method according to claim 12, further comprising a step of moving the downhole tool forward, whereby the guiding nose hits against a wall of the side track, thereby guiding the tool into the side track.

14. The method according to claim 12, further comprising a step of using a downhole tractor.

15. A downhole tool for guiding a device into a side track of a borehole, the tool having a tool axis and comprising:

a guiding nose for guiding the tool into the side track, and a joint for providing a revolving and pivoting motion of the guiding nose, wherein the tool comprises a bushing comprising a terminal surface facing the joint and being inclined in relation to a plane perpendicular to the tool axis, wherein the bushing is able to slide along the tool axis to fixate the guiding nose in a position in which the nose inclines in relation to the tool axis, wherein the tool further comprises a driving unit for rotating the bushing, and wherein the tool housing further comprises a toothed rim bushing for providing a rotation of the bushing by an interacting device, the toothed rim bushing being rotatable in relation to the tool housing and being placed concentrically around the tool axis.

16. A downhole tool configured to operate downhole in a wellbore including at least one sidebore, comprising:

an outer tool housing;

a joint mechanics housing concentric and radially aligned with the outer tool housing, the joint mechanics housing being continuous with the outer tool housing in a longitudinal direction;

a shaft arranged centrally within and running a length of at least the joint mechanics housing;

a joint having a first joint part and a second joint part; the first joint part being arranged within a downhole end of the joint mechanics housing and at a downhole end of the shaft;

a nose unit comprising a nose body and the second joint part at an uphole end of the nose unit, the second joint part being complementary to the first joint part and configured to be arranged within the downhole end of the joint mechanics housing in connection with the first joint part; and a cylindrical bushing arranged around the shaft configured to be rotated around the shaft and displaced axially within the joint mechanics housing;

wherein rotation and axial movement of the cylindrical bushing is configured to actuate the nose unit such that the nose unit is configured to move within a conical pattern around a longitudinal tool axis.

17. The downhole tool according to claim 16, wherein the shaft comprises a through bore running a length of the shaft.

18. The downhole tool according to claim 17, wherein the through bore is configured to accommodate at least wires configured to power a second device arranged downhole of the downhole tool.

19. The downhole tool according to claim 17, wherein the nose unit comprises a nose unit through bore running a length of the nose unit.

20. The downhole tool according to claim 19, wherein the nose unit through bore is configured to accommodate at least wires configured to power a second device arranged downhole of the tool.

21. The downhole tool according to claim 19, wherein the through bore and the nose unit through bore are configured to accommodate a fiberglass wire.

22. The downhole tool according to claim 21, wherein the fiberglass wire is configured to deform elastically at a further joint formed by the nose unit and the joint mechanics housing when the further joint is arranged such that the through bore and nose unit through bore are not aligned.

23. The downhole tool according to claim 16, wherein the cylindrical bushing has a first end arranged at a downhole end of the cylindrical bushing and a second end arranged at an uphole end of the cylindrical bushing, wherein:

the second end is configured as a plane perpendicular to the tool axis;

the first end is configured as a plane at an angle between parallel to and perpendicular to the tool axis; and the first end is configured to interact with the second joint part to actuate the nose unit.

* * * * *